US008747337B2

(12) United States Patent
Lee

(10) Patent No.: US 8,747,337 B2
(45) Date of Patent: Jun. 10, 2014

(54) INTERACTIVE MASSAGING DEVICE

(71) Applicant: Wing Pow International Corp., Chatsworth, CA (US)

(72) Inventor: Calvin Spencer Lee, Northridge, CA (US)

(73) Assignee: Wing Pow International Corp., Chatsworth, CA (US)

( * ) Notice: Subject to any disclaimer, the term of this patent is extended or adjusted under 35 U.S.C. 154(b) by 0 days.

(21) Appl. No.: 13/858,286

(22) Filed: Apr. 8, 2013

(65) Prior Publication Data

US 2013/0226050 A1 Aug. 29, 2013

Related U.S. Application Data

(63) Continuation of application No. 13/606,966, filed on Sep. 7, 2012, which is a continuation of application No. 12/723,426, filed on Mar. 12, 2012, now Pat. No. 8,308,667.

(51) Int. Cl.
*A61H 19/00* (2006.01)

(52) U.S. Cl.
CPC ..... *A61H 19/44* (2013.01); *A61H 19/34* (2013.01); *A61H 19/50* (2013.01); *A61H 2201/0153* (2013.01); *A61H 2201/5079* (2013.01); *A61H 2201/5061* (2013.01)
USPC ..... 601/46; 600/38

(58) Field of Classification Search
CPC ..... A61H 19/34; A61H 19/44; A61H 19/50; A61H 2201/0153; A61H 2201/5061; A61H 2201/5079
USPC ..... 128/845; 446/490; 600/38; 601/46, 72
See application file for complete search history.

(56) References Cited

U.S. PATENT DOCUMENTS

| | | | |
|---|---|---|---|
| 3,417,743 | A | 12/1968 | Carrera |
| 4,162,675 | A | 7/1979 | Kawada |
| 4,515,167 | A | 5/1985 | Hochman |
| 4,779,615 | A | 10/1988 | Frazier |
| 4,909,263 | A | 3/1990 | Norris |
| 5,516,396 | A | 5/1996 | Maurer et al. |

(Continued)

FOREIGN PATENT DOCUMENTS

| | | | |
|---|---|---|---|
| DE | 202004010534 | U1 | 5/2005 |
| DE | 102004033932 | A1 | 9/2005 |

(Continued)

OTHER PUBLICATIONS

European Search Report and European Search Opinion for European Application No. 08009779.3-1257; Aug. 18, 2008.

(Continued)

*Primary Examiner* — Nicholas Lucchesi
*Assistant Examiner* — Gerald Landry, II
(74) *Attorney, Agent, or Firm* — Sheldon Mak & Anderson

(57) ABSTRACT

A vibratory massaging device having a spaced plurality of proximity sensors distributed on a massaging surface of the device, and a control circuit operative for controlling vibratory intensities in response to activation of particular ones of the sensors being close to a user's body parts being massaged. The device can be configured as a dildo, including both main and secondary vibrators, the secondary vibrator being within an arm portion that is configured for clitoral stimulation. At least one of the vibrators is automatically driven at increased intensity as penetration increases.

19 Claims, 3 Drawing Sheets

(56) References Cited

U.S. PATENT DOCUMENTS

| | | | | |
|---|---|---|---|---|
| 5,561,879 | A | 10/1996 | Everall | |
| 5,573,499 | A | 11/1996 | McAllister | |
| 5,601,529 | A | 2/1997 | Wollman | |
| 5,941,834 | A | 8/1999 | Skladnev | |
| 6,063,022 | A | 5/2000 | Ben-Haim | |
| 6,175,981 | B1 | 1/2001 | Lizama et al. | |
| 6,183,427 | B1 | 2/2001 | Ishii | |
| 6,190,307 | B1 | 2/2001 | Tsai | |
| 6,280,403 | B1 | 8/2001 | Lok | |
| 6,350,230 | B1 | 2/2002 | Kontos | |
| 6,378,150 | B1 | 4/2002 | Minegishi et al. | |
| 6,616,621 | B1 | 9/2003 | Kohr | |
| 6,632,185 | B2 | 10/2003 | Chen | |
| 6,647,572 | B2 | 11/2003 | Lee | |
| 6,648,840 | B2 | 11/2003 | Cutler et al. | |
| 6,741,895 | B1 | 5/2004 | Gafni et al. | |
| 6,758,826 | B2 | 7/2004 | Luettgen et al. | |
| 6,902,525 | B1 | 6/2005 | Jewell | |
| 6,976,970 | B2 | 12/2005 | Siddhartha | |
| 7,081,087 | B2 | 7/2006 | Jannuzzi | |
| 7,104,950 | B2 | 9/2006 | Levy | |
| 7,122,015 | B2 | 10/2006 | Luettgen et al. | |
| 7,438,681 | B2 * | 10/2008 | Kobashikawa et al. | 600/38 |
| 7,452,326 | B2 | 11/2008 | Fladl et al. | |
| 7,503,892 | B2 | 3/2009 | Squicciarini | |
| 7,527,589 | B2 | 5/2009 | Squicciarini | |
| 7,559,886 | B2 | 7/2009 | Knyrim | |
| 7,608,037 | B2 * | 10/2009 | Levy | 600/38 |
| 7,803,126 | B2 * | 9/2010 | Nan | 601/72 |
| 2002/0029008 | A1 | 3/2002 | Pow Wong et al. | |
| 2002/0103415 | A1 | 8/2002 | Manska et al. | |
| 2003/0036678 | A1 | 2/2003 | Abbassi | |
| 2003/0083590 | A1 | 5/2003 | Hochman et al. | |
| 2004/0186344 | A1 | 9/2004 | Jannuzzi | |
| 2005/0012406 | A1 | 1/2005 | Moret | |
| 2005/0014560 | A1 * | 1/2005 | Blumenthal | 463/36 |
| 2005/0070827 | A1 | 3/2005 | Lee | |
| 2005/0113636 | A1 | 5/2005 | Tucker | |
| 2005/0113724 | A1 | 5/2005 | Wriggle | |
| 2005/0159685 | A1 | 7/2005 | Klein et al. | |
| 2005/0228219 | A1 | 10/2005 | Jewell | |
| 2006/0047181 | A1 | 3/2006 | Hsu | |
| 2006/0069329 | A1 | 3/2006 | Nan | |
| 2006/0084837 | A1 | 4/2006 | Klearman et al. | |
| 2006/0094992 | A1 | 5/2006 | Imboden et al. | |
| 2006/0143092 | A1 | 6/2006 | Gardos et al. | |
| 2006/0150451 | A1 * | 7/2006 | Spielberger et al. | 40/412 |
| 2007/0038019 | A1 | 2/2007 | Weng | |
| 2007/0149903 | A1 | 6/2007 | Nan | |
| 2007/0179336 | A1 | 8/2007 | Knyrim | |
| 2007/0179414 | A1 | 8/2007 | Imboden et al. | |
| 2008/0009775 | A1 | 1/2008 | Murison | |
| 2008/0065187 | A1 * | 3/2008 | Squicciarini | 607/143 |
| 2008/0082028 | A1 | 4/2008 | Blevins | |
| 2008/0119767 | A1 | 5/2008 | Berry et al. | |
| 2008/0207990 | A1 * | 8/2008 | Nan | 600/38 |
| 2008/0208083 | A1 | 8/2008 | Lin et al. | |
| 2009/0093673 | A1 | 4/2009 | Lee | |
| 2009/0093856 | A1 * | 4/2009 | Attila et al. | 607/6 |
| 2009/0099413 | A1 | 4/2009 | Kobashikawa et al. | |
| 2009/0112055 | A1 | 4/2009 | Hyde et al. | |
| 2009/0171144 | A1 * | 7/2009 | Squicciarini | 600/38 |
| 2009/0177128 | A1 * | 7/2009 | Fukuyama et al. | 601/98 |
| 2009/0270674 | A1 * | 10/2009 | Trzecieski | 600/38 |
| 2010/0174212 | A1 * | 7/2010 | Shim | 600/587 |
| 2011/0218395 | A1 | 9/2011 | Stout | |

FOREIGN PATENT DOCUMENTS

| | | | |
|---|---|---|---|
| DE | 102005042092 | A1 | 10/2007 |
| DE | 202007012531 | U1 | 12/2007 |
| EP | 0472965 | A1 | 3/1992 |
| EP | 1720503 | B1 | 6/2007 |
| EP | 2047833 | B1 | 4/2009 |
| WO | 2005084605 | A1 | 9/2005 |
| WO | 2007041853 | A1 | 4/2007 |

OTHER PUBLICATIONS

The First Office Action of the State Intellectual Property Office of China in Chinese Patent Application No. 200810134310.7; May 31, 2010. (No English Translation Available).

European Search Report and European Search Opinion for European Application No. 10004175.5-1257; Mar. 18, 2011.

The second office action issued in Chinese Patent Application No. 200810134310.7 (filed on Jul. 22, 2008), issued on Aug. 31, 2011. (No English translation available).

Notice of Opposition from European Patent Office in Application No. 08009779.3, dated May 27, 2011 (1 page).

Opposition Papers Filed in European Patent Application No. 08009779.3, dated May 17, 2011, by Jörg Knyrim (10 pages).

Final Rejection Issued in U.S. Appl. No. 11/971,797, dated Apr. 27, 2010 (8 pages).

Office Action from Chinese Application No. 201110056473.X, issued on Sep. 13, 2013, 14 pages.

* cited by examiner

INTERACTIVE MASSAGING DEVICE

CROSS-REFERENCE TO RELATED APPLICATIONS

This application is a continuation of U.S. application Ser. No. 13/606,966, filed Sep. 7, 2012, which is a continuation of U.S. patent application Ser. No. 12/723,426, filed Mar. 12, 2010, the contents of which are incorporated by reference herein in their entirety.

BACKGROUND

The present invention relates to massaging apparatus, and more particularly to sexual stimulation devices.

Sexual stimulation devices of the prior art include dildos that have vibratory elements such as disclosed in U.S. Application Publication No 2002/1013415 and International Publication No. WO 2007/041853. It is also known to provide controls for various modes of operation. However, it is believed that none of this class of devices of the prior art has proven entirely satisfactory, for a variety of reasons. For example, manipulation of controls by the user to produce changes in operation tends to detract from desired effects to be obtained from the device.

Thus there is a need for a massaging apparatus that provides improved stimulation without requiring a user to manipulate controls for producing changes in operation.

SUMMARY

The present invention meets this need by providing a vibratory massaging device that automatically changes in operation in response to proximity and/or contact between body parts to be massaged and particular locations on the device. In one aspect of the invention, the device includes a housing; a vibrator supported in the housing; a spaced plurality of proximity sensors supported in the housing; and a control circuit connected between the proximity sensors and the vibrator for driving the vibrator at plural predetermined levels in response to particular ones of the proximity sensors coming into close proximity with user's body parts being massaged by the device. The device can further include means for receiving a battery element within the device for powering the vibrator and the control circuit, and a removable cap for enclosing the battery element within the device. The device can further include the battery element, which can itself include a battery pack. The device can also include a control button supported by the cap for activation of the control circuit.

The massaging device can be formed having a main outside surface defining a substantially cylindrical shape, being rounded at one end thereof, the proximity sensors being positioned proximate the outside surface and longitudinally disposed. The device can further include a sleeve covering the housing and defining the main outside surface. The means for receiving a battery element can include the removable cap forming a rounded end portion of the device opposite the one end, and the control button being coaxially located by the cap.

The control circuit is preferably operative for powering the vibrator at a first, low intensity when a first one of the proximity sensors is activated, and at a second, medium intensity when a second one of the proximity sensors is activated for enhanced massaging effectiveness in response to operator manipulation. More preferably, the control circuit is further operative for powering the vibrator at a third, higher intensity when a third one of the sensors is activated.

Preferably the main outside surface has a shape of an erect penis for forming vibratory dildo. Preferably the vibrator is a main vibrator, the elastic sleeve further including a laterally projecting arm portion, the dildo further having a secondary vibrator enclosed in the arm portion, the control circuit being further operative for powering the secondary vibrator. Preferably the dildo includes mode control means for operator control of plural modes of operation of the control circuit. The mode control means can include a mode actuator, the control circuit being responsive to successive operations of the mode actuator for activation in each corresponding mode. The modes can include a first mode of operation wherein both vibrators are inactive unless at least one of the proximity sensors is activated, and a second mode, at least one of the vibrators being activated otherwise; and a second mode wherein at least one of the vibrators is activated at a higher intensity than that in which it is activated in the first mode. There can be first and second ones of the proximity sensors, the first proximity sensor being located between the second proximity sensor and a head extremity of the sleeve, the second mode being activated in response to the second sensor. Preferably there can be a third one of the proximity sensors, the third proximity sensor being located beyond the second proximity sensor from the head extremity of the sleeve, a third mode being activated at an even higher intensity than that of the second mode in response to the third sensor.

DRAWINGS

These and other features, aspects, and advantages of the present invention will become better understood with reference to the following description, appended claims, and accompanying drawings, where:

DESCRIPTION

Figure 1:
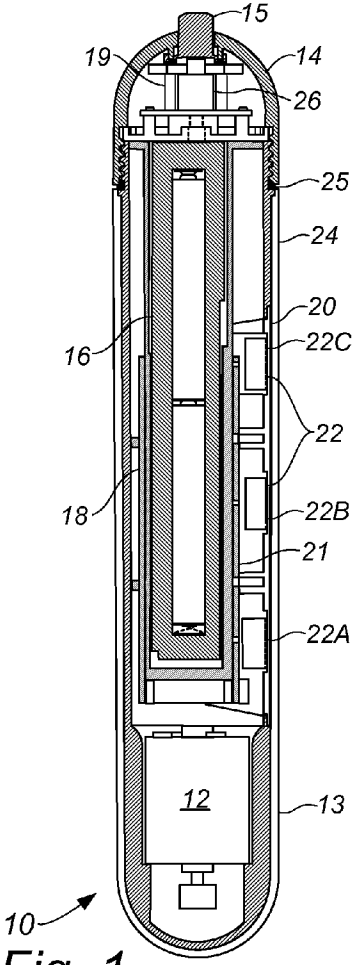
FIG. 1 is a lateral sectional view of a massaging device according to the present invention.
Figures 2, 3:
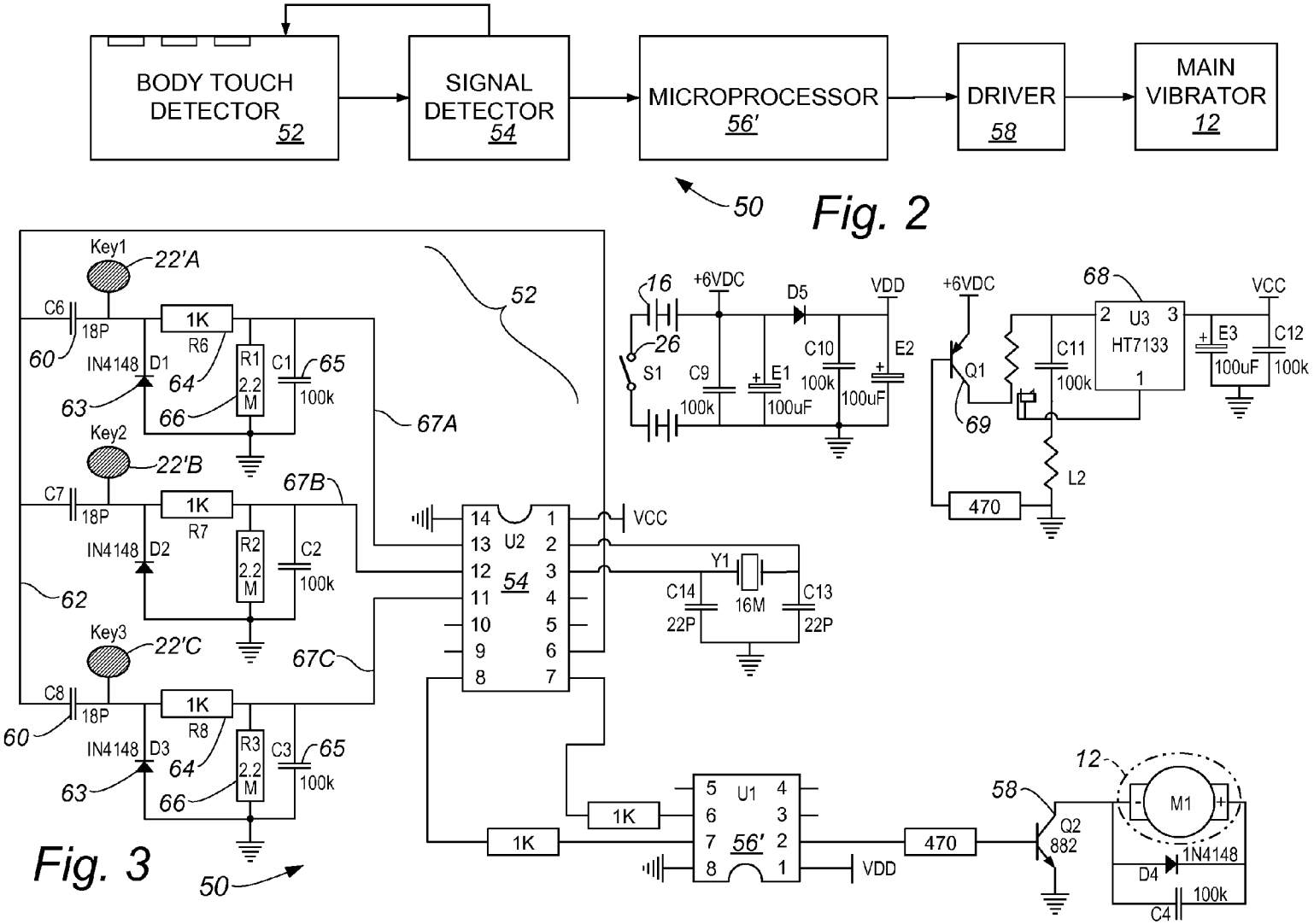
FIG. 2 is a block diagram of a control circuit for the dildo of FIG. 1.
FIG. 3 is a schematic diagram of the control circuit of FIG. 2.

The present invention is directed to a massaging device that is particularly effective in stimulating body parts such as female genitalia. With reference to FIGS. 1-3 of the drawings, a massaging device 10 includes a motorized vibrator 12 mounted in an elongate housing 13, a screw-on cap 14 detachably connected to the housing and having a control button 15 projecting therefrom, a battery pack 16 inserted within the housing, a control module 18 and a sensor module 20 mounted in the housing and including a sensor circuit board 21 supporting a longitudinally distributed plurality of sensor elements 22 according to the present invention, the elements being individually designated 22A, 22B, and 22C, the element 22C being closest to the control button 15, the element 22A being closest to the opposite end of the device 10. The housing 13 is also covered with a sleeve 24, and the assembly is sealed with an elastic O-ring 25 interposed between the sleeve and the cap 14. In the exemplary configuration shown in the drawings, the device 10 has a cylindrical shape with spherically rounded ends, the control button 15 projecting from one end of the device.

The control button 15 operates a "push-on/push-off" power switch 26 that is mounted on a switch structure 19 within the cap 15 for activating the device 10. Also included is appropriate wiring or other conductors (not shown) between the vibrator 12, the battery pack 16, the control module 18, the sensor module 20, and the control switch 26. When activated, the device assumes an idle state unless and until a user's body part comes into close proximity with one of the sensor elements 22. As more particularly described in connection with FIGS. 2 and 3 below, proximity with the sensor element 22A only produces a first or low level of activation of the vibrator 12; proximity with the sensor element 22B (but not 22C) produces a second or medium level of activation; and proximity with the sensor element 22C produces a third or high level of activation of the vibrator 12.

Figure 5:
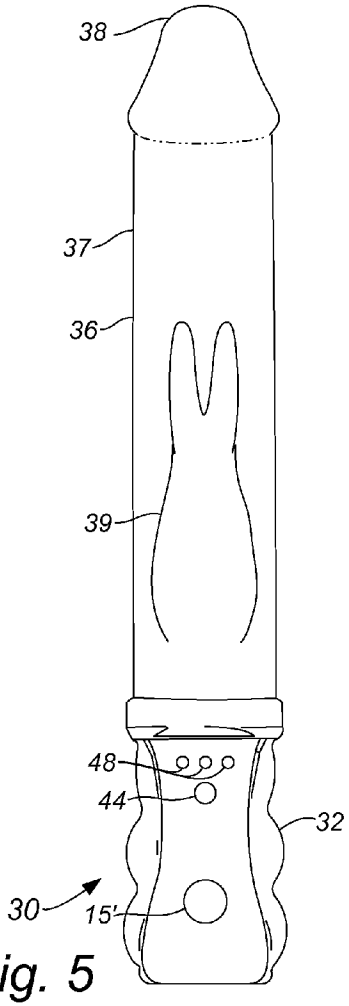
FIG. 5 is a front side view of the dildo of FIG. 4.
Figure 4:
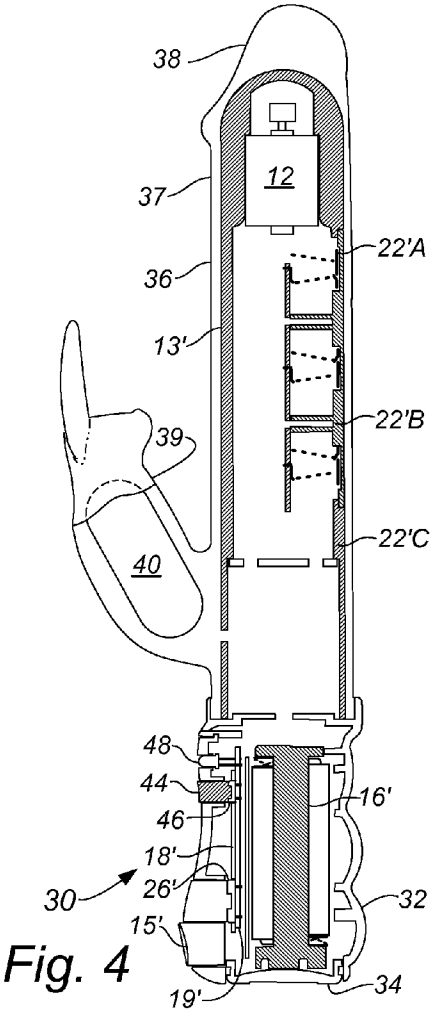
FIG. 4 is a lateral side sectional view showing an alternative configuration of the device of FIG. 1 in the form of a dildo.

With further reference to FIGS. 4 and 5, an alternative configuration of the massaging device, designated dildo 30, includes counterparts of the motorized vibrator 12, the housing, designated 13', control button, designated power button 15', the battery pack, designated 16', the control module, designated 18' and the control circuit board, designated 19', the sensor module, designated 20' and the sensor circuit board, designated 21' with counterparts of the sensor elements, designated 22' (individually 22'A, 22'B, and 22'C), and a momentary counterpart of the power switch, designated 26'. The battery pack 16' is supported within a handle 32 and retained in place by a screw-in cap 34. The power button 15' projects through the handle 32, the control module 18' being located within the handle.

An elastic counterpart of the sleeve, designated 36 has a main portion 37 covering the housing 13' and having the form of an erect penis with a head portion 38, and an arm portion 39 projecting to one side in a shape and dimension preferably facilitating contact with the clitoris of a user of the dildo, the arm portion enclosing a motorized secondary vibrator 40 that is locatingly supported within an arm cavity 42 of the arm portion 39. Each of the sensor elements 22' is biasingly pressed against the sleeve by a sensor spring 42, the element 22'A being closest to the head portion 38 of the sleeve 36, the element 22C being farthest therefrom. As described above in connection with the massager 10, appropriate wiring or other conductors (not shown) connect the battery pack 16', the control module 18', the sensor module 20, and the vibrators 12 and 40.

The exemplary configuration of the dildo 30 of FIGS. 2 and 3 further includes a mode switch actuator 44 protruding the handle 32 for operation by a user and having a mode switch 46 that is mounted directly on the control circuit board 19'. A plurality of intensity indicators 48 also project through the handle, being supported by the control circuit board. The mode switch 46 sequentially selects a plurality of vibration modes, selectively modifying operation the vibrators 12 and 40 in combination with response to the sensors 22' as described above for the massaging device 10.

Suitable materials for the housings 13 and 13', and the handle 32 include ABS. Suitable materials for the battery packs 16 and 16' include polypropylene; and suitable materials for the sleeve 36 (and the control button 15 of FIG. 1) include elastic plastic materials such as TPE. A suitable battery complement is four type AAA alkaline batteries.

Figure 6:
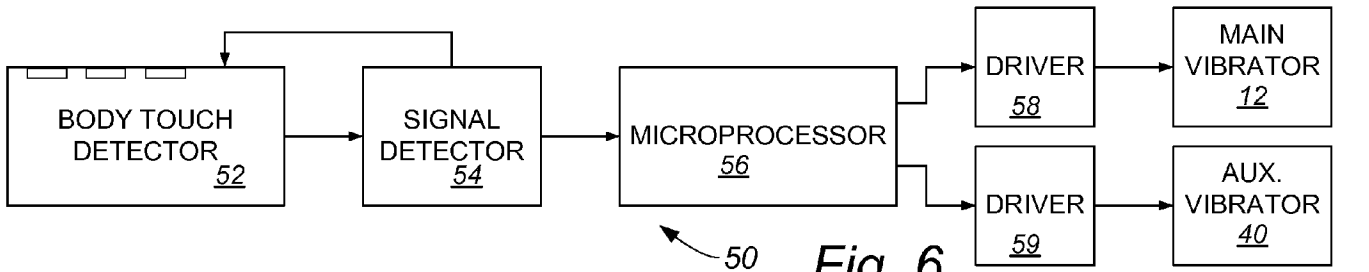
FIG. 6 is a block diagram of a control circuit for the dildo of FIG. 4.
Figure 7:
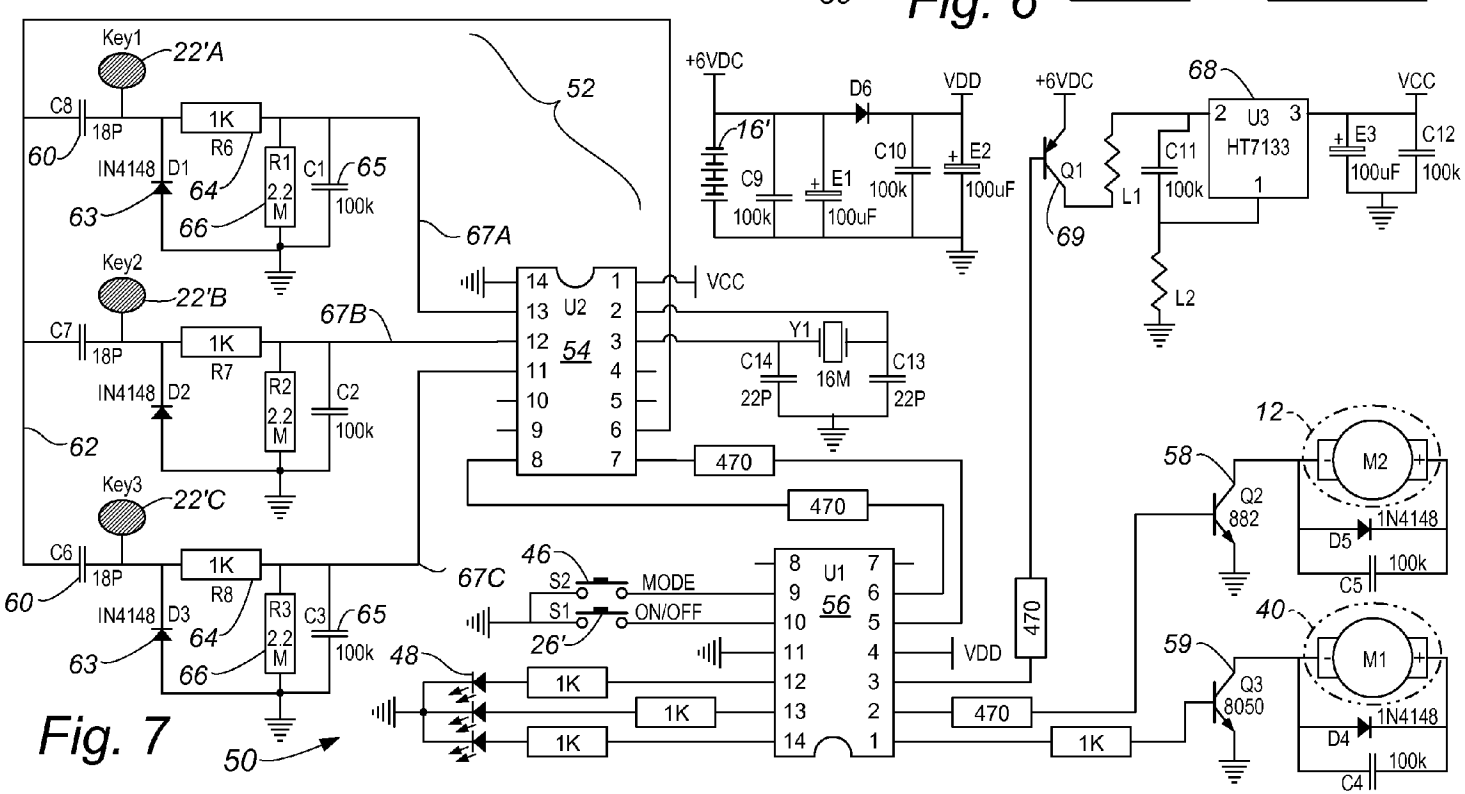
FIG. 7 is a schematic diagram of the control circuit of FIG. 6.

With particular reference to FIGS. 6 and 7, a control circuit 50 of the dildo 30 is formed by a combination of the control module 18' and the sensor module 20'. As shown in FIG. 6, the control circuit 50 includes a body touch detector 52, that operates in combination with a signal detector 54 that signals a microprocessor 56, the microprocessor controlling a main driver 58 for powering the main vibrator 12, and a secondary driver 59 for powering the secondary vibrator 40.

The touch detector 52 includes the sensor elements 22'A, 22'B, and 22'C, the elements 22' each having a coupling capacitor 60 connected to a common pulse output 62 of the signal detector 54, and a grounded blocking diode 63 connected for maintaining a positive potential at the sensor element 22'. That potential is fed through a signal filter that includes a charging resistor 64, a filter capacitor 65, and a discharge resistor 66, the resulting filtered touch signal 67 being fed to a corresponding input of the detector 54. The touch signals are individually designated 67A, 67B, and 67C in FIG. 7, corresponding respectively to the sensor elements 22'A, 22'B, and 22'C. The signal detector 54 monitors each of the touch signals 67, periodically communicating status signals to the microprocessor 56. When any of the sensor elements comes into close proximity to a user's body part, capacitive coupling alters (increases) loading of the associated coupling capacitor, correspondingly changing (decreasing) the resulting touch signal sufficiently to change the relevant status signal.

In addition to the above-described communication with the signal detector 54, the microprocessor is responsive to the power switch 26' and the mode switch 46 for signaling the main and secondary drivers 58 and 59 as further described below, the microprocessor having separate outputs for driving each of the indicators 48.

In an exemplary configuration of the dildo 30, the control circuit 50, upon activation by the power switch 26', is responsive to the mode switch 46 for controlling the secondary vibrator 40 as described herein, the main vibrator 12 being responsive to proximity of the sensor elements 22' as described above regarding the sensor elements 22 of the massaging device 10. In this configuration, successive activations of the mode switch 46 produces eight intensity modes of operation of the secondary vibrator 40 as set forth below in Table 1. It will be understood that other modes of operation of the secondary vibrator 40 are within the scope of the present invention. Corresponding variations in operation intensity levels of the main vibrator 12 are possible also, an exemplary schedule being indicated below in Table 2, graphic waveforms of intensity corresponding to those of table 1 being omitted due to lack of space. In table 2, "Sensor A" excludes activation of the sensor elements 22'B and 22'C; "Sensor B" excludes activation of the sensor element 22'C. In both tables the activation levels are relative and arbitrary as is consistent with effective levels known to those skilled in the art.

TABLE 1

| Secondary Vibrator Modes | | | |
|---|---|---|---|
| Mode | Level | Shape | Graphic |
| 1 | 0 | — | |

TABLE 1-continued

| Secondary Vibrator Modes | | | |
|---|---|---|---|
| Mode | Level | Shape | Graphic |
| 2 | 1 | Flat | |
| 3 | 2 | Flat | |
| 4 | 3 | Flat | |
| 5 | 3/0 | Sinusoid | |
| 6 | 3/0 | Medium Square | |
| 7 | 3/0 | Medium/Slow Square | |
| 8 | 2/0 | Fast Square | |

TABLE 2

| Main Vibrator Modes | | | | | |
|---|---|---|---|---|---|
| | Level | | | | |
| Mode | No Sensor | Sensor A | Sensor B | Sensor C | Shape |
| 1 | 0 | 1 | 2 | 3 | Flat |
| 2 | 0 | 2 | 3 | 4 | Flat |
| 3 | 0 | 1 | 3 | 5 | Flat |
| 4 | 1 | 2 | 4 | 5 | Flat |
| 5 | 2/0 | 3/0 | 4/0 | 5/0 | Sinusoid |
| 6 | 0 | 1/0 | 3/0 | 5/0 | Medium Sq. |
| 7 | 0 | 1/0 | 3/0 | 5/0 | Med./Slow Sq. |
| 8 | 0 | 1/0 | 3/0 | 5/0 | Fast Square |

The indicators 48 are driven by the control circuit 50 at low intensity in Modes 1 and 2, medium intensity in Mode 3, high intensity in Mode three, variable intensity in Mode 4, and blinking in modes 5-8 synchronously with activation of the secondary vibrator 40. It will be understood that other and various indications in the different modes are possible.

A suitable device for the signal detector 54 is available as ACM3890 from Shizhenshi ACME Micro Electronics of Shenzhen, China. The device is operational with a crystal input at 16 MHz, generating the pulse output 62 at a rate of 500 Hz. A suitable device for the microprocessor 56 is available as ACM3831-3, also from ACME. A suitable 3.3 volt regulator 68 for providing VCC to the detector 54 is available as HT7133 from Holtek Semiconductor Inc. Of Hsinshu, Taiwan. The regulator 68 is fed by a power driver 69 in response to activation of the microprocessor 56 by the power switch 26' as described above. The control circuit 50 includes additional conventional circuitry for powering the signal detector 54 as well as the microprocessor 56 in a suitable manner known to those skilled in the art.

Further regarding the massaging device 10 of FIG. 1, and with particular reference to FIGS. 2 and 3, a simplified counterpart of control circuit, designated 50' is formed by a combination of the control module 18 and the sensor module 20. As shown in FIG. 2, the control circuit 50' includes counterparts of the body touch detector 52 and the signal detector 54 for signaling a counterpart of the microprocessor, designated 56', the microprocessor controlling a counterpart of the main driver 58 for powering the vibrator 12. A suitable device for the microprocessor 56' is available as ACM3831-2, also from ACME. The power switch 26 directly powers the control circuit 50'; accordingly, the power driver 69 is implemented as a constant conduit to the regulator 68 when the power switch 26 is activated.

The touch detector 52 includes the sensor elements 22A, 22B, and 22C, the elements 22 each having the coupling capacitor 60 connected to the common pulse output 62 of the signal detector 54, with counterparts of the blocking diode 63, the signal filter including the charging resistor 64, the filter capacitor 65, and the discharge resistor 66, for generating the touch signal 67 for feeding the detector 54 as described above in connection with FIG. 7. The signal detector 54 monitors each of the touch signals 67A, 67B, and 67C, periodically communicating status signals to the microprocessor 56', also as described above. The control circuit 50' also includes conventional circuitry for powering the signal detector 54 and the microprocessor 56' in a suitable manner known to those skilled in the art.

Although the present invention has been described in considerable detail with reference to certain preferred versions thereof, other versions are possible. For example, the power switch and the mode switch can be combined, the control circuit cycling through a substantially unpowered state and the various modes in response to successive operations of the mode switch. Therefore, the spirit and scope of the appended claims should not necessarily be limited to the description of the preferred versions contained herein.

What is claimed is:

1. A sex toy device comprising:

a housing;

a motor;

a control circuit;

a first proximity sensor located in an insertable portion of the device that produces signals to the control circuit; wherein the speed of the motor varies in response to the signals, and wherein the device is arranged such that the first proximity sensor automatically produces the signals in response to the first proximity sensor coming into close proximity with a user's body part.

2. The sex toy device of claim 1, wherein the housing comprises a flexible material.

3. The sex toy device of claim 2 wherein the first proximity sensor is disposed on or within the flexible material.

4. The sex toy device of claim 1, wherein the first proximity sensor come into close proximity with the user's body parts by the user bending, grasping, squeezing, shaking, swiping, stretching, or compressing the device.

5. The sex toy device of claim 1, wherein the first proximity sensor is a capacitive touch sensor.

6. The sex toy device of claim 1, wherein the speed of the motor is varied to produce different levels of vibration.

7. The sex toy device of claim 1, further comprising a second proximity sensor that signals the control circuit, wherein activation of the second proximity sensor produces a higher vibration of the motor compared to activation of the first proximity sensor.

8. A method comprising:

activation of a sensor on an insertable portion of a sex toy device, wherein the sensor is automatically activated by coming into close proximity with a user's body part;

signaling a control circuit in response to activation of the sensor; and altering the speed of a motor in response to activation of the control circuit.

9. The method of claim 8, wherein the motor is disposed within a housing comprising a flexible material.

10. The method of claim 9, wherein the sensor is a proximity sensor, and wherein the sensor is disposed on or within the flexible material.

11. The method of claim 8, wherein the method is performed in response to using a sex toy.

12. The method of claim 8, wherein the sensor is activated by bending, grasping, squeezing, shaking, swiping, stretching, or compressing the device.

13. The method of claim 8, wherein the sensing is performed by a capacitive touch sensor.

14. The method of claim 8, wherein the speed of the motor is varied to produce vibration.

15. The method of claim 8, also comprising:

activation of a second sensor on a device producing a second control signal in response to sensing said sensing of an in-situ gesture; and altering the speed of the motor in response to the first control signal in conjunction with the second control signal.

16. The sex toy device of claim 7, further comprising a third proximity sensor that signals the control circuit, wherein activation of the third proximity sensor produces a higher vibration of the motor compared to activation of the second proximity sensor.

17. The sex toy device of claim 1, further comprising a push button power switch.

18. A device comprising:

a housing;

a control circuit;

a motor;

a first proximity sensor located in an insertable portion of the device that produces a first signal to the control circuit, wherein the motor vibrates at a first speed in response to the first proximity sensor coming into close proximity with a user's body part; and a second proximity sensor that produces a second signal to the control circuit, wherein the motor vibrates at a second speed in response to the second proximity sensor coming into close proximity with a user's body part, wherein the second speed is higher than the first speed.

19. The device of claim 18 further comprising a third proximity sensor that produces a third signal to the control circuit, wherein the motor vibrates at a third speed in response to the third proximity sensor coming into close proximity with a user's body part, and wherein the third speed is higher than the second speed.

* * * * *